United States Patent [19]

von Hein et al.

[11] Patent Number: 5,029,829

[45] Date of Patent: Jul. 9, 1991

[54] COLLECTING CYLINDER FOR POINT FOLDERS OF ROTARY MACHINES

[75] Inventors: Edward von Hein, Bern; Viktor Boronka, Muenchenbuchsee, both of Switzerland

[73] Assignee: WIFAG, Bern, Switzerland

[21] Appl. No.: 406,792

[22] Filed: Sep. 13, 1989

[30] Foreign Application Priority Data

Sep. 13, 1988 [DE] Fed. Rep. of Germany ..... 3831182

[51] Int. Cl.[5] ..... B42C 1/00

[52] U.S. Cl. ..... 270/47; 270/13; 493/424; 493/442

[58] Field of Search ..... 270/13–15, 270/45, 47–50; 493/424, 442, 454

[56] References Cited

U.S. PATENT DOCUMENTS

| | | | |
|---|---|---|---|
| 1,976,853 | 10/1934 | Lundqust | 270/47 |
| 3,263,988 | 8/1966 | Heimlicher | 270/50 |
| 4,378,268 | 3/1983 | Lehmacher | 270/47 |

FOREIGN PATENT DOCUMENTS

| | | |
|---|---|---|
| 1611330 | 2/1968 | Fed. Rep. of Germany . |
| 2040494 | 8/1970 | Fed. Rep. of Germany . |
| 2530365 | 7/1975 | Fed. Rep. of Germany . |
| 417646 | 8/1964 | Switzerland . |

*Primary Examiner*—Edward K. Look
*Assistant Examiner*—Therese M. Newholm
*Attorney, Agent, or Firm*—McGlew and Tuttle

[57] ABSTRACT

A collecting cylinder for point folders of rotary machines, the circumferential surface of which consists of a number circumferential segments (5), which are next to one another in the direction of the cylinder axis but some distance apart, extend in the circumference in each case groupwise from point holes to point holes and are supported at one of two ends on bearings on eccentric shafts (6) and the radial interval of which can jointly be changed nonpositively. At least one eccentric shaft (6) of each circumferential segment group (5') is supported on bearings in the collecting cylinder so that it can be swung out radially and each eccentric shaft (6) is connected by means of an adjusting lever (10) and a connecting rod (11) with an adjusting disk (12), which is rotatably supported on bearings centrically to the collecting cylinder (1). (3 Figures)

6 Claims, 3 Drawing Sheets

COLLECTING CYLINDER FOR POINT FOLDERS OF ROTARY MACHINES

FIELD OF THE INVENTION

The invention relates to a circular collecting cylinder for point folders of rotary machines in which the circumferential surface of the cylinder consists of a number of circumferential segments. The segments are adjacent one another in the direction of the cylinder axis and are spaced some distance apart, extending in the circumferential direction, in each case from point holes to point holes. The segments are supported at their two ends on bearings on eccentric shafts. The radial disposition of the segments may be changed in a nonpositive sense.

BACKGROUND OF THE INVENTION

Collecting cylinders of variable diameter in different designs are generally known. Such collecting cylinders are required to regulate the paper pull if the products collected have different thicknesses.

Collecting cylinders with circumferential elements extending from point holes to point holes have also become known through the Swiss Patent 417,646. Neither in the one nor in the other design are the circumferential elements adjusted by way of eccentric shafts.

Practical arrangements have been provided including a collecting cylinder for point folders of rotary machines in which the cylinder circumferential surface includes a number of circumferential segments which are positioned adjacent one another. The segments are disposed extending groupwise from point holes to point holes supported at their two ends on bearings and are movable outwardly. The circumferential elements of such an arrangement are supported at their two ends on bearings on ecentric shafts, by means of which a radial adjustment of the circumferential elements becomes possible. So that this adjustment always takes place simultaneously for each group of circumferential elements, each ecentric shaft carries a pinion gear, which engages a spur-toothed wheel that is rotatably supported on bearings centrically to the collecting cylinder (see also German Patent 2,040,494). By changing the angle between this spur-toothed wheel and the collecting cylinder, the radial position of the circumferential segments and thereby the active diameter of the collecting cylinder are also automatically changed.

The above-mentioned constructions have the disadvantage that the circumferential segments make difficult or even prevent any access to the inner parts of the collecting cylinder, so that, for tasks such as exchanging or replacing folding plates, they must first of all be removed from the collecting cylinder, to which accessibility in the folding apparatus is limited in any case.

The above-mentioned gearwheel connection has a further disadvantage. If the setting of the diameter of the collecting cylinder remains the same for a long time, this connection can become contaminated by paper dust, etc. to such an extent, that it seizes or jams during a subsequent adjustment.

SUMMARY AND OBJECTS OF THE INVENTION

It is therefore an object of the invention to provide a collecting cylinder, which avoids the disadvantages listed.

Pursuant to the invention, this objective is accomplished owing to the fact that at least one eccentric shaft of each circumferential segment group is supported on bearings in the collecting cylinder body, so that it can be swung out radially.

Due to the inventive measure, the inner parts of the collecting cylinder can be made almost freely accessible. A further measure permits any circumferential element groups to be swung out, without having to release the actuating drive of its eccentric shafts.

It is also an object of the invention to provide a circular collecting cylinder, mounted for rotation about a central axis which is accessible which permits circumferential element groups to be swung out and is simple in design, rugged in construction and economical to manufacture.

The various features of novelty which characterize the invention ar pointed out with particularity in the claims annexed to and forming a part of this disclosure. For a better understanding of the invention, its operating advantages and specific objects obtained by its uses, reference is made to the accompanying drawings and descriptive matter in which a preferred embodiment of the invention is illustrated.

DESCRIPTION OF THE PREFERRED EMBODIMENT

Figure 1:
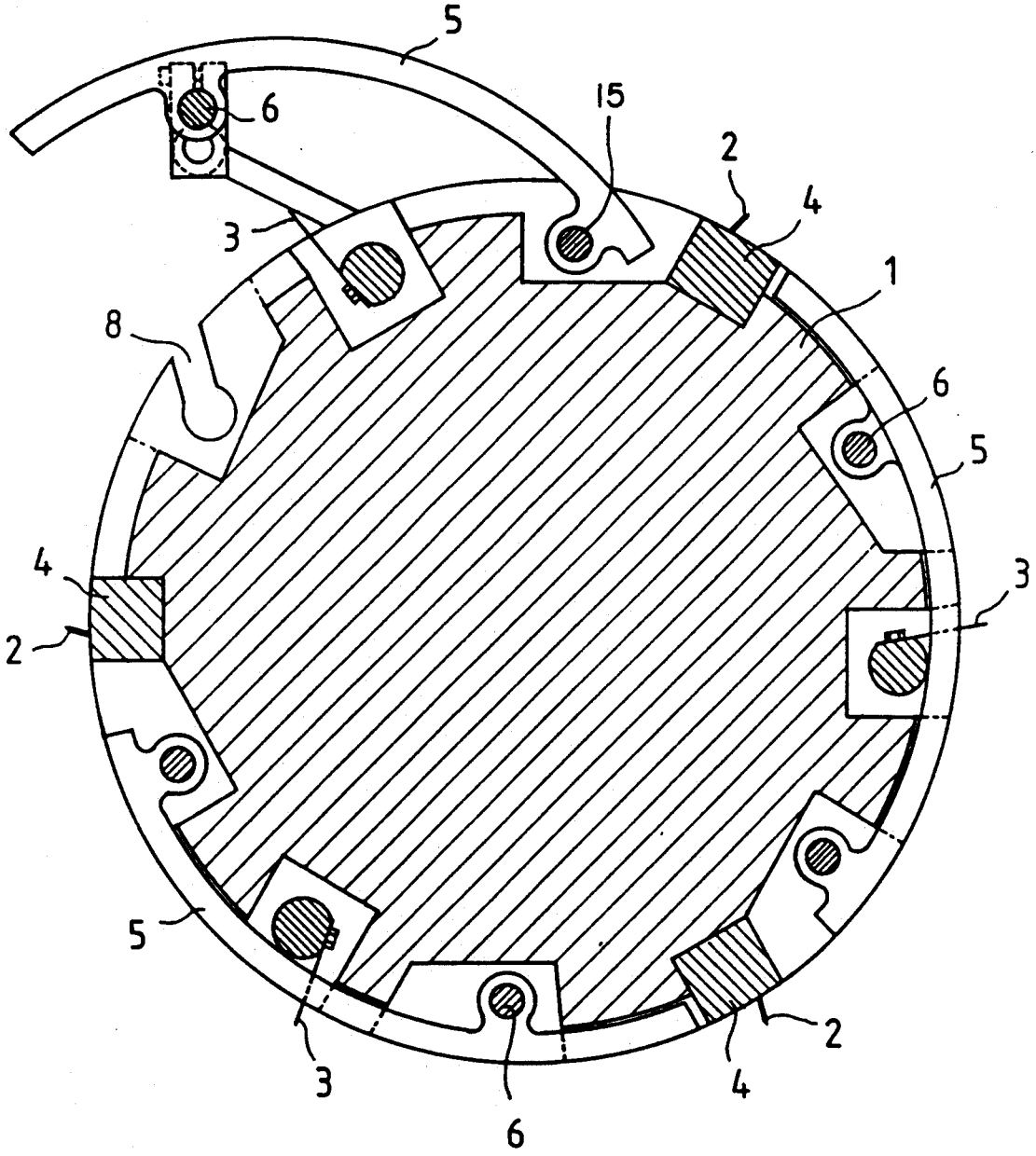
FIG. 1 is a cross sectional view through a collecting cylinder with a circumferential element group swung out.
Figure 2:
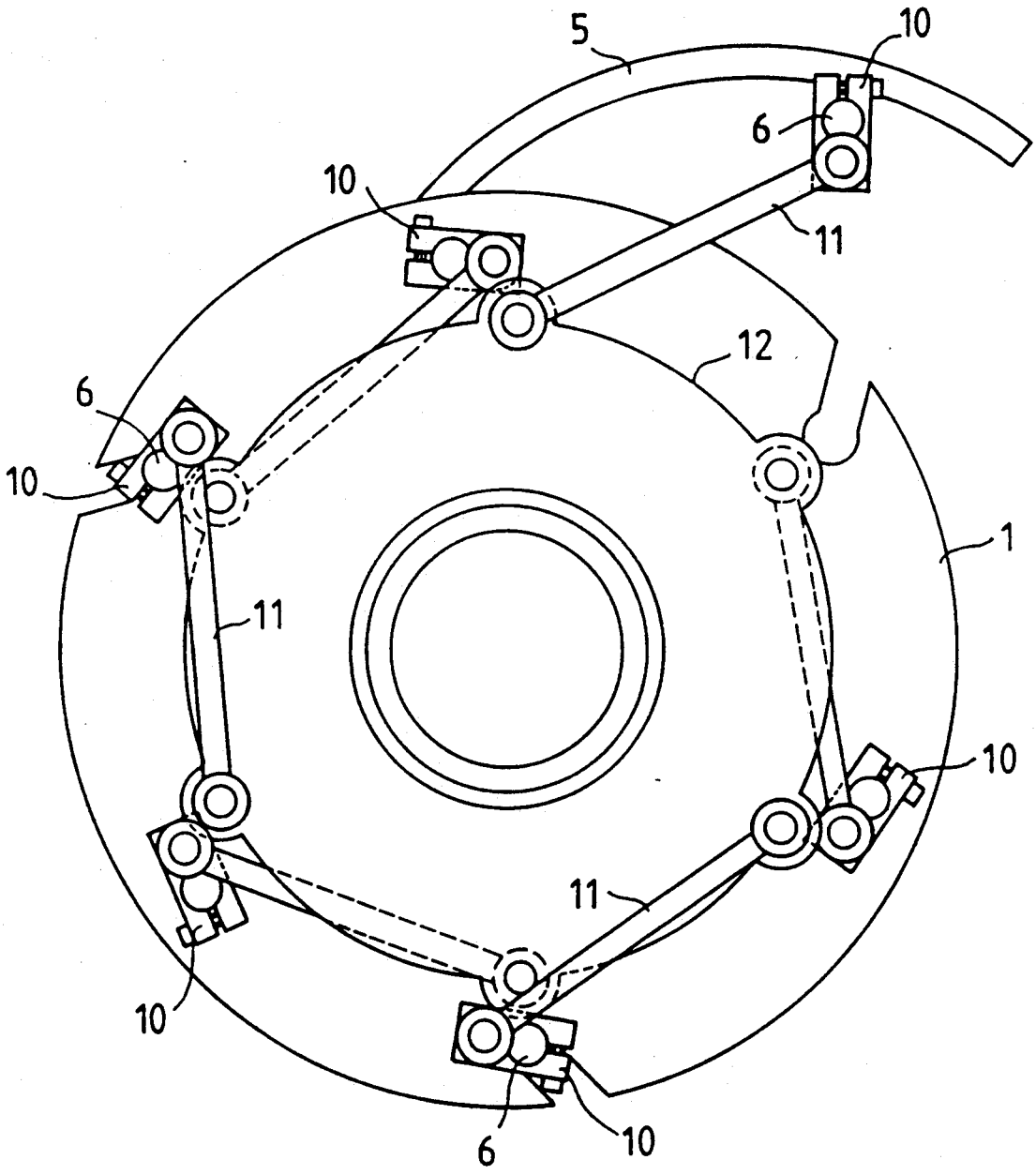
FIG. 2 is an end view showing an actuating drive side of a collecting cylinder.
Figure 3:
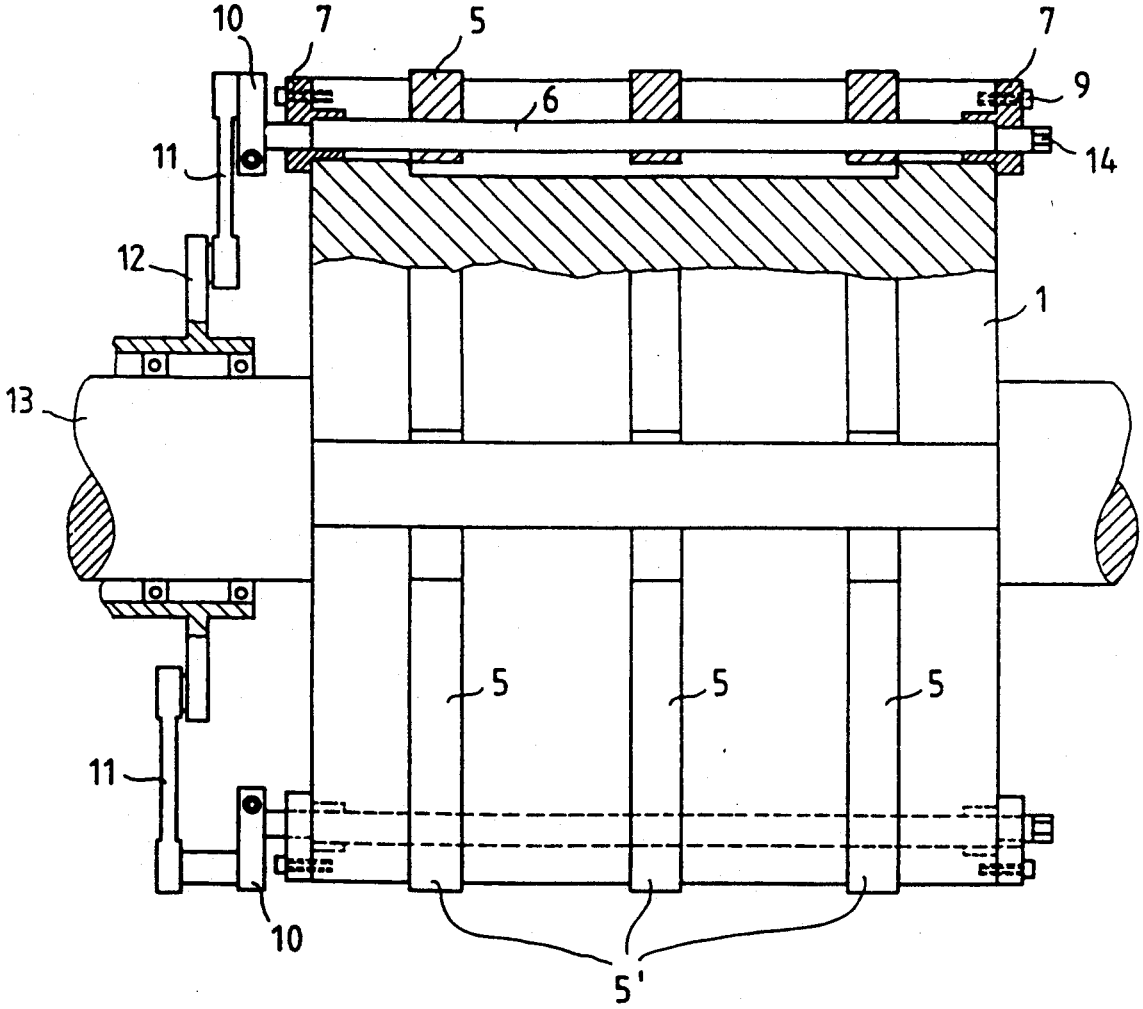
FIG. 3 is a view of a collecting cylinder with a section through a bearing-supported eccentric shaft, which can be swung out.

Referring to the drawings in particular, the invention embodied therein comprises a collecting cylinder 1 having a circumferential surface including point holes 4 and including a plurality of circumferential segments 5, each circumferential segment being spaced from and positioned adjacent at least one other circumferential segment 5, forming a group of circumferential segments 5'. Each group of circumferential segments 5' extends between two of the point holes 4. Circumferential segments are supported at a first end by an eccentric shaft, with an axis of rotation which is ecentric with respect to a central axis connected to the circumferential segment of the collecting cylinder and at a second end by another shaft 15 mounted for rotation on said collecting cylinder. At least one end of the shaft 6 of each circumferential group is supported by swing out bearing means connected to the collecting cylinder for swinging out the segment 5 radially.

The collecting cylinder 1 is equipped in a known manner with controlled puncture needles 2 and folding plates 3. At the circumference of the collecting cylinder 1, the circumferential segments 5, which lie next to one another in groups and at a distance from one another, and the two ends of which are supported on bearings on eccentric shafts 6, are disposed in each case between two point holes 4. At least one part of eccentric shaft 6 of each circumferential segment group 5' is guided on both sides in bearing 7, which are accommodated in slots 8 and can be fixed in the proper position, for example, by screws or other known means. By loosening these fixations, each eccentric shaft 6, so supported, and with that the circumferential segment group 5 associated with it can be swung out manually.

On one end of each eccentric shaft 6, an adjusting lever 10 is rigidly mounted. This adjusting lever 10 is hinged by means of a connecting rod 11 to an adjusting disk 12. The adjusting disk 12 in turn is rotatably supported on bearings centrically to the collecting cylinder 1, for example, on the axis 13 of the collecting cylinder, and connected either with a known, mechanical, remote control that is not shown or, in the case of a simple design for manual adjustment, with a suitable fixation device.

For the purpose of manual adjustment, the other end of each eccentric shaft 6 is provided, for example, with a hexagon 14 or the like, to which a conventional lathe tool can be attached.

While a specific embodiment of the invention has been shown and described in detail to illustrate the application of the principals of the invention, it will be understood that the invention may be embodied otherwise without departing from such principals.

What is claimed is:

1. A Collecting Cylinder for point folders of rotary machines, comprising: a circumferential surface including a plurality of circumferential segments, each segment being adjacent another segment in the direction of a cylinder axis, spaced a distance apart, each segment extending in a circumferential direction in groups from point holes to point holes, set in groups of segments being supported at a first segment end by a eccentric shaft, said eccentric shaft having a portion of large diameter supporting said circumferential segments and a portion of small diameter having an axis of rotation offset from a central axis of said portion of large diameter, said eccentric shaft being supported by swing out bearing means, positioned in the collecting cylinders, for swinging out the segments radially.

2. A collecting cylinder according to claim 1, wherein each shaft is provided with an actuating drive, each shaft being constantly connected to a corresponding set of actuating drives.

3. A collecting cylinder according to claim 1, wherein at least one of said shafts is mounted to an adjusting lever and connected to a connecting rod for movement therewith, an adjusting disc being connected to said connecting rod, said adjusting disc being rotatably supported on bearings coaxial with said collecting cylinder.

4. A collecting cylinder according to claim 3, wherein said adjusting disc is provided at an angle with respect to said collecting cylinder, said angle being changeable either remotely while the machine is running or while the machine is stopped.

5. A collecting cylinder according to claim 1, wherein at least one of said shafts is constructed such that the radial position of the circumferential segments may be changed manually at said at least one of said shafts.

6. A Collecting Cylinder for point folders of rotary machines, comprising: a circumferential surface including a plurality of circumferential segments, each segment being adjacent another segment in the direction of a cylinder axis, a distance apart, each segment extending in a circumferential direction in groups from point holes to point holes, set in groups of segments being supported at a first segment end by a eccentric shaft, said eccentric shaft having a portion of large diameter supporting said circumferential segments and a portion of small diameter having an axis of rotation offset from a central axis of said portion of large diameter, said eccentric shaft being supported by swing out bearing means, positioned in the collecting cylinders, for swinging out the segments radially, said swing out bearing means including a bearing supporting said eccentric shaft portion of small diameter, an adjusting lever engaging said eccentric shaft a connecting rod, connected to said adjusting lever and an adjusting disc connected to said connecting rod and mounted for rotation about the cylinder axis, movement of said adjusting disc causing said connecting rod to move said adjusting lever for adjusting the position of said segments.

* * * * *